United States Patent [19]

Filip

[11] Patent Number: 4,907,491

[45] Date of Patent: Mar. 13, 1990

[54] EXTENDED-TRAVEL ACTUATOR WITH CLAMPS ON ROD AND CYLINDER END FOR CLAMPING CENTRAL ROD

[76] Inventor: Stanislaw F. Filip, 1245 Martingrove Road, Rexdale, Ontario, Canada

[21] Appl. No.: 231,694

[22] Filed: Aug. 12, 1988

[30] Foreign Application Priority Data

Aug. 14, 1987 [CA] Canada ..... 544622

[51] Int. Cl.[4] ..... F15B 15/26; F01B 15/02

[52] U.S. Cl. ..... 91/44; 92/20; 92/28; 92/29; 92/117 A

[58] Field of Search ..... 92/20, 29, 117 R, 117 A, 92/181 R, 27, 28; 91/151, 44

[56] References Cited

U.S. PATENT DOCUMENTS

| | | | |
|---|---|---|---|
| 931,611 | 8/1909 | Hutchings | 92/3 X |
| 2,531,907 | 11/1950 | Daubenmeyer | 92/29 |
| 3,133,469 | 5/1964 | Ljungberg | 92/29 X |
| 3,176,590 | 4/1965 | Uhtenwoldt et al. | 92/28 X |
| 3,586,138 | 6/1971 | Engle | 92/27 X |
| 3,597,016 | 8/1971 | Gachot | 92/27 X |
| 3,805,679 | 4/1974 | Wray | 92/29 X |
| 4,185,539 | 1/1980 | Stratienko | 92/27 X |

FOREIGN PATENT DOCUMENTS

| | | | |
|---|---|---|---|
| 2649958 | 5/1978 | Fed. Rep. of Germany | 92/28 |
| 1042490 | 11/1953 | France | 92/29 |
| 802659 | 2/1981 | U.S.S.R. | 92/28 |

*Primary Examiner*—Robert E. Garrett
*Assistant Examiner*—George Kapsalas
*Attorney, Agent, or Firm*—Zarley McKee, Thomte, Voorhees & Sease

[57] ABSTRACT

The cylinder has a sealed back wall through which the rod passes. A piston assembly mounted on the rod between the back wall and a cylinder front end-piece contains a fluid-pressure-activated clamp. The front end-piece also has a clamp. By sequenced operation alternatively fixing the piston or the cylinder to the rod through the respective clamp, the relative travel of cylinder and rod can be extended to any desired length.

2 Claims, 1 Drawing Sheet

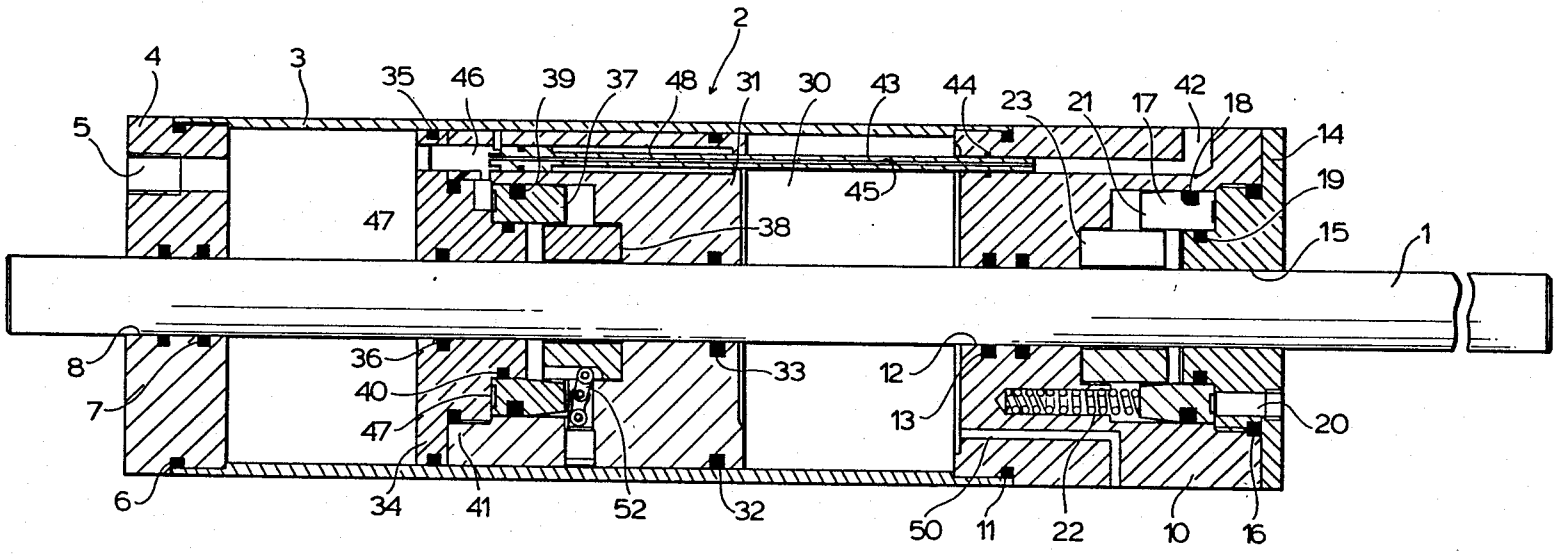
1
14
19
15
20
16
18
42
10
17
21
22
23
11
44
50
12
13
43
45
30
38
33
2
31
32
48
52
37
39
41
46
35
47
36
40
47
34
3
4
5
8
7
6

EXTENDED-TRAVEL ACTUATOR WITH CLAMPS ON ROD AND CYLINDER END FOR CLAMPING CENTRAL ROD

BACKGROUND OF THE INVENTION

1. Field of the Invention

This invention relates to improvements in devices generally known as expansion chambers or otherwise known as hydraulic or pneumatic cylinders. More particularly, it is concerned with the type of device which, under the pressure of a fluid, causes a rod, connected to a piston, to move longitudinally, commonly coaxially, relative to a surrounding cylindrical chamber.

2. Description of the Prior Art

The mechanical advantage of expansion chambers of the type also known as a piston and cylinder have been known for some time. They include the internal combustion engine and hydraulic devices for earth moving equipment, automobile jacks, cranes, and many other types of equipment, including elevators.

Although it is often unimportant, devices in which a rod is rigidly fixed to a piston which moves within a cylinder under fluid pressure are limited by the fact that the travel of the cylinder or piston rod is limited to the length of the internal chamber of the cylinder. Therefore, if it was desired to have an extended length of travel, it would be necessary to provide an equally long cylinder which often provides problems where there is inadequate room. Thus, hydraulic cylinders are rarely found to be useful in the design of elevators of any substantial height.

SUMMARY OF THE INVENTION

It is the purpose of the present invention to present a device in which a cylinder may move along a length of a rod of indefinite length, or alternatively, a fixed cylinder may effect an extended movement of a movable rod of substantially unlimited length.

A device of this nature could be useful in raising elevators in tall buildings or effecting the travel of machinery or work pieces along an assembly line, or a variety of other such uses.

The foregoing advantages are sought to be achieved with the present invention by providing a rod of a given length surrounded by a cylinder of shorter length in which the cylinder has a wall at one end sealed against the rod and a wall at the opposite end sealed against the rod forming a chamber between in which there is a piston assembly mounted on the rod capable of moving between a rearward and a forward position within the chamber of the cylinder under fluid pressure. A clamp on one end of the cylinder and another clamp on the piston assembly allow the cylinder or the piston assembly to be clamped alternately to the rod while the other moves allowing the cylinder to move an indefinite length relative to and along the rod.

BRIEF DESCRIPTION OF THE DRAWING

The invention may be best understood by a description of one embodiment with reference to the accompanying drawing.

DETAILED DESCRIPTION OF THE PREFERRED EMBODIMENT

In the illustrated embodiment a rod 1 of substantial, indefinite length, is surrounded over a portion of its length by a cylinder 2 of short length. The rod and cylinder are concentrically located about a common axis and are designed to move with a degree of force axially relative to one another. In other words the rod may be fixed and the cylinder will move along the length of the rod, or alternatively, the cylinder may be fixed and the rod will be caused to move axially through the centre of the cylinder.

The cylinder is composed of a number of elements, including a cylindrical wall 3, a back wall 4 having a port 5 extending therethrough, a set of seals 6 designed to seal the back wall to the cylindrical wall, and a set of seals 7 designed to form a seal between the back wall and the rod 1 where it passes through a central bore 8. At the other end of the cylinder is an end piece 10 fitted in the cylindrical wall 3 and closed by means of the seals 11 having a central bore 12 through which passes the rod 1 closed by means of the seals 13. At the far side of the end piece is a cap 14 having a central bore 15 to accommodate the rod 1, the space between the end piece and the cap being closed by a seal 16.

Between the cap and the end piece is inserted (in a recess of the end piece) a circular ring 17 sealed against the end piece at 18 and against the cap at 19.

The ring 17 is capable of moving within the end piece backwards (towards the back wall) axially, under pressure applied through the port 20 in the end of the cap. The back edge 21 of the ring is tapered, or narrowed, to provide a wedgelike shape. A spring 22 is mounted rearward of the ring 17 to force it in a forward direction when no pressure is applied through the port 20.

Mounted within the central recess of the end piece, and partially within the rearward edge of the cylindrical rings 17, is a set of ring segments 23, each segment of which surrounds a portion of the circumference of the rod 1 so that the set substantially surrounds the entire circumference with enough tolerance to contract tightly around the rod or expand to surround it loosely.

Within the cylindrical wall 3, between the back wall 4 and the end piece 10, is located a piston assembly 30 comprising a body piece 31 which is sealed against the cylindrical wall at 32 and against the rod at 33, and a piston cap 34 sealed against the cylindrical wall at 35 and against the rod at 36.

Like the forward end of the cylinder, the piston assembly has a circular ring 37 and a segmented ring 38 which closely surround the rod 1. The cylindrical ring of the piston 37 is sealed against the body and against the cap at 39 and 40 respectively. Similarly, the cap and body portion are sealed against each other at 41.

The end piece 10 is provided with a conduit 42 which in turn is connected to a hollow tube 43 movable within the horizontal portion of the conduit 42 through a seal 44 having a central bore 45 communicating to a chamber 46 which in turn communicates to the chamber 47 on the back side of the ring 37.

The tube 43 is also movable within a longitudinal bore 48 within the body of the piston assembly but sealed therewith.

The operation of the device can best be described by a sequence of steps by which the rod or the cylinder can be caused to travel longitudinally or axially relative to the other.

For example, if hydraulic or pneumatic fluid from a pressurized source is administered through the port 20 of the cap 14, pressure will be exerted on the forward face of the circular ring 17 causing it to travel rearward (towards the back wall) so that the tapered rearward edge thereof will press like a wedge against the outer surface of the ring segment 23 forcing them to clamp tightly around the circumference of the rod 1. If pressure is then applied through the port 5 of the back wall 4, it will pressurize the interior of the cylinder behind the piston assembly moving it towards the end piece 10 while any fluid in the cylinder ahead of the piston is evacuated through the port 50. During this movement the circular ring 37 of the piston assembly is under no pressure and the segmented ring 38 is free to move along the rod.

After the piston assembly has reached the position adjacent to the forward end piece 10, pressure is applied through the conduit 42 while the pressure initially exerted through the ports 20 and 5 is relaxed. The pressurized fluid will be conveyed through the conduit 42 and the bore 45 of the tube 43 to the chamber 46 and the chamber 47 where pressure will be exerted behind the circular ring 37 moving it forward causing it to act as a wedge to clamp the segmented ring 38 tightly about the circumference of the rod 1 so as to hold the piston in a fixed longitudinal position relative to the rod.

If pressure is now applied through the port 50 the piston will remain fixed on the rod while pressure in the chamber forward of the piston will cause the cylinder 2 to move forward until the cap of the piston approaches the position adjacent to the back wall 4.

Thus, if the rod is fixed the cylinder will move forward. Alternatively, if the cylinder is fixed the rod will move rearward. If the sequence of pressure applied to the ports 20, 5, 42, and 50 is repeated, the cylinder will move relative to the rod one more distance equivalent to the travel of the piston in the cylinder. The sequence can be repeated as often as necessary and the travel of the cylinder on the rods can be extended to any practical length.

To reverse the travel pressure can be applied through the port 42 to clamp the piston on the rod and then through the port 5 to move the cylinder rearward before ring 23 is clamped by pressure through the port 20.

As an auxiliary, or an alternative mechanism, a toggle lock 52 is provided in the recess surrounding the segmented ring 38 in the piston assembly so that when the circular ring 37 is moved in the forward direction, the toggle lock, which consists of two links pivoted at their adjacent ends, will be forced in a straightened direction causing the segmented ring 38 to clamp the rod. A set of two or three or more of these can be positioned radially about the assembly.

It will, of course, be realized that variations and modifications of the illustrated embodiment may be employed without departing from the inventive concept herein.

I claim:

1. An expansion chamber having extended travel comprising:

a rod of a given length;

a cylinder of shorter length of said rod surrounding a portion of said rod and movable along the length of said rod;

said cylinder comprising a cylindrical wall axially parallel to said rod;

a back wall forming one end of said cylinder sealed against said rod;

a front end piece forming the other end of said cylinder and sealed against said rod;

a piston assembly mounted on said rod within said cylindrical wall between said back wall and said front end piece and sealed against said cylinder wall and against said rod;

a front end piece clamp to releasably clamp said front end piece to said rod;

a piston assembly clamp to releasably clamp said piston assembly to said rod;

means to apply fluid pressure selectively to the interior of said cylinder between said piston assembly and said back wall and between said piston assembly and said front end piece so as to move said piston assembly between a forward position and a rearward position in said cylinder; and said front end piece clamp and said piston assembly clamp being activated by fluid pressure.

2. The expansion chamber of claim 1 in which a tube communicates fluid pressure between the rearward side of said piston and a port in the front piece, which tube is telescopingly connected to and sealed against said front piece to allow movement of said piston relative to said front piece.

* * * * *